US009909410B2

(12) United States Patent
Mata

(10) Patent No.: US 9,909,410 B2
(45) Date of Patent: Mar. 6, 2018

(54) DEPTH, LOAD AND TORQUE REFERENCING IN A WELLBORE

(71) Applicant: Halliburton Energy Services, Inc., Houston, TX (US)

(72) Inventor: Miguel Luis Mata, Corinth, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 207 days.

(21) Appl. No.: 15/022,095

(22) PCT Filed: Nov. 14, 2013

(86) PCT No.: PCT/US2013/070055
§ 371 (c)(1),
(2) Date: Mar. 15, 2016

(87) PCT Pub. No.: WO2015/073002
PCT Pub. Date: May 21, 2015

(65) Prior Publication Data

US 2016/0222778 A1 Aug. 4, 2016

(51) Int. Cl.
*E21B 47/00* (2012.01)
*E21B 47/09* (2012.01)
(Continued)

(52) U.S. Cl.
CPC ..... *E21B 47/09* (2013.01); *E21B 29/06* (2013.01); *E21B 47/00* (2013.01); *E21B 47/0006* (2013.01); *E21B 47/04* (2013.01)

(58) Field of Classification Search
None
See application file for complete search history.

(56) References Cited

U.S. PATENT DOCUMENTS 4,359,898 A 11/1982 Tanguy et al.
4,760,735 A 8/1988 Sheppard et al.
(Continued)

FOREIGN PATENT DOCUMENTS

EA 200970476 A1 12/2009
EA 201070591 A1 10/2010
(Continued)

OTHER PUBLICATIONS

Extended Search Report issued for European Patent Application No. 13897539.6 dated May 5, 2017, 7 pages.
(Continued)

*Primary Examiner* — Jill Culler

(57) ABSTRACT

A downhole depth, load and torque reference system. The system includes a well feature disposed within a wellbore tubular having a depth reference element, a load reference element and a torque reference element. A mating assembly is operable to be run downhole within the wellbore tubular on a conveyance. The mating assembly is operable to contact the depth reference element of the well feature to identify the depth of the well feature, operable to engage the torque reference element of the well feature such that rotation of the conveyance at the surface transmits sufficient torque to break the torque reference element to identify torque efficiency at the depth and operable to engage the load reference element of the well feature such that applying weight at the surface to the conveyance transmits sufficient load to break the load reference element to identify load efficiency at the depth.

20 Claims, 4 Drawing Sheets

(51) Int. Cl.
*E21B 29/06* (2006.01)
*E21B 47/04* (2012.01)

(56) References Cited

U.S. PATENT DOCUMENTS

| | | | | |
|---|---|---|---|---|
| 5,044,198 | A | 9/1991 | Ho | |
| 5,287,921 | A * | 2/1994 | Blount | E21B 7/061 166/117.6 |
| 5,386,724 | A | 2/1995 | Das | |
| 5,467,821 | A * | 11/1995 | Sieber | E21B 7/061 166/123 |
| 2004/0020648 | A1 | 2/2004 | Dewey et al. | |

FOREIGN PATENT DOCUMENTS

| | | |
|---|---|---|
| EP | 0916014 A1 | 5/1999 |
| RU | 2232247 C2 | 7/2004 |
| RU | 2283941 C1 | 9/2006 |

OTHER PUBLICATIONS

Russian Search Report issued for Russian Patent Application No. 2016116781, 4 pages (with translation).
International Search Report, dated Aug. 25, 28014, PCT/US2013/070055, 3 pages, ISA/KR.
Mirhaj, et al., "Improvement of Torque-and-Drag Modeling in Long-Reach Wells," Modern Applied Science, Oct. 2011, vol. 5, No. 5, pp. 10-28.

* cited by examiner

DEPTH, LOAD AND TORQUE REFERENCING IN A WELLBORE

The present application is a U.S. National Stage patent application of International Patent Application No. PCT/US2013/070055, filed on Nov. 14, 2013, the benefit of which is claimed and the disclosure of which is incorporated herein by reference in its entirety.

TECHNICAL FIELD OF THE DISCLOSURE

This disclosure relates, in general, to equipment utilized in conjunction with operations performed in relation to subterranean wells and, in particular, to a system and method for depth, load and torque referencing in a wellbore.

BACKGROUND

Without limiting the scope of the present disclosure, its background will be described in relation to forming a window in a casing string for a multilateral well, as an example.

In multilateral wells, it is common practice to drill a branch or lateral wellbore extending outwardly from an intersection with a main or parent wellbore. Typically, once the parent wellbore casing string is installed and the parent wellbore has been completed, a whipstock is positioned in the parent wellbore casing string at the desired intersection and then a rotating mill is deflected laterally off the whipstock to form the window through the parent wellbore casing sidewall, enabling subsequent drilling and completing of the lateral wellbore. In some installations, the mill assembly and the whipstock may be run downhole together as a unit. In such installations, the mill assembly may initially be attached to the whipstock face with one or more shear bolts. Once positioned in the desired location, for example after a latch assembly associated with the whipstock is anchored into and rotationally oriented within a latch coupling interconnected in the parent wellbore casing string, the mill assembly may be separated from the whipstock responsive to compressive shearing.

In certain well configurations, however, such as wells having a tight dog leg or extended reach horizontal wells, it has been found that significant friction is introduced into the well system, which greatly affects the surface load required to compressively shear the shear bolts coupling the mill assembly to the whipstock face. In such configurations, it may therefore be difficult to determine the desired strength for the shear bolts to enable proper installation, separation and operation of the mill assembly and the whipstock. Accordingly, a need has arisen for a system and method for determining the losses associated with a downhole in well system having, for example, a high friction configuration.

BRIEF DESCRIPTION OF THE DRAWINGS

For a more complete understanding of the features and advantages of the present disclosure, reference is now made to the detailed description along with the accompanying figures in which corresponding numerals in the different figures refer to corresponding parts and in which.

DETAILED DESCRIPTION

Figure 1:
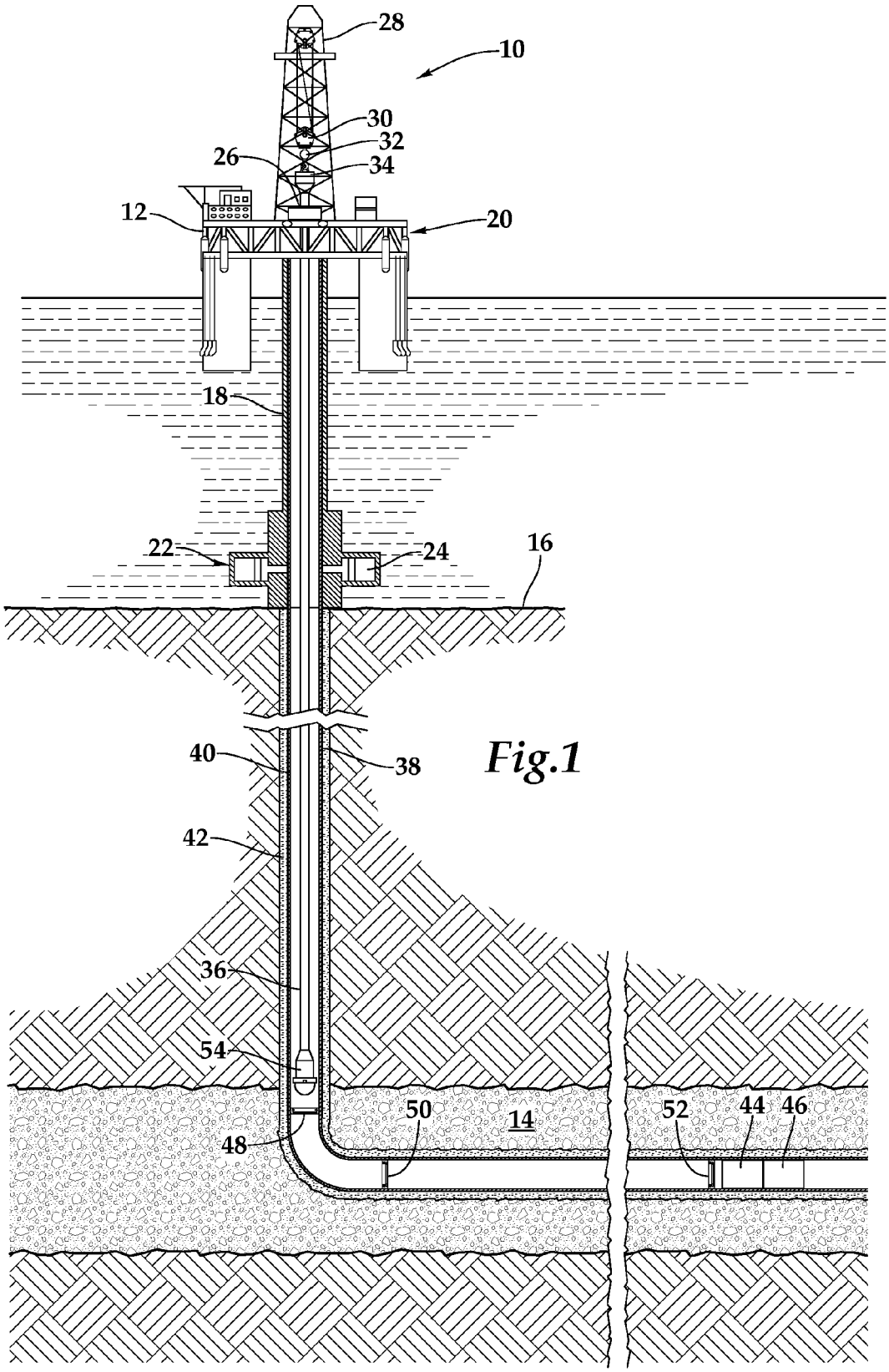
FIG. 1 is a schematic illustration of an offshore oil and gas platform operating a system for depth, load and torque referencing in a wellbore according to an embodiment of the present disclosure.
Figure 2A:
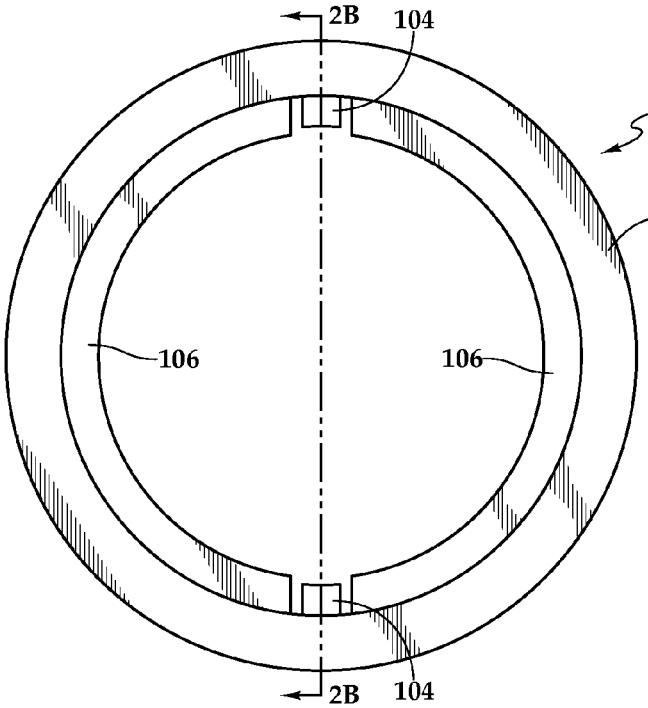
FIGS. 2A-2D are various views of a well feature for use in a system for depth, load and torque referencing in a wellbore according to an embodiment of the present disclosure.
Figure 2B:
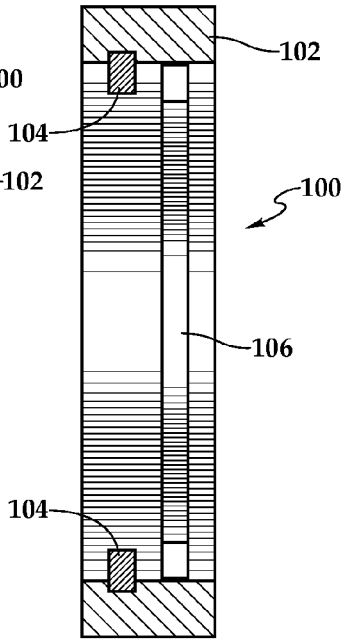
Figure 2C:
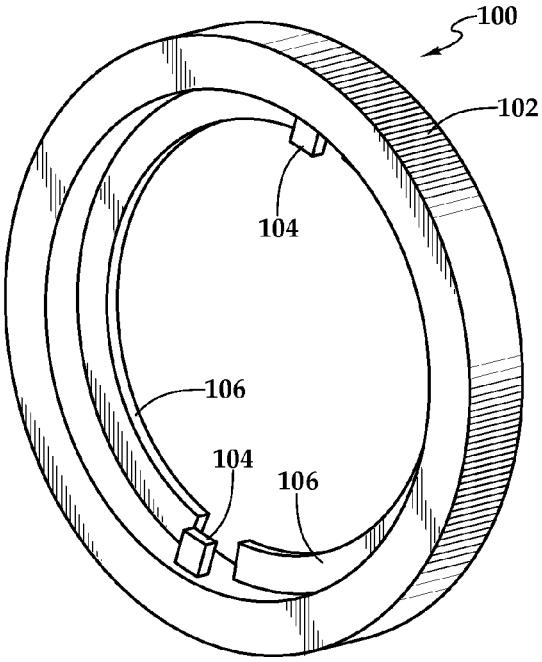
Figure 2D:
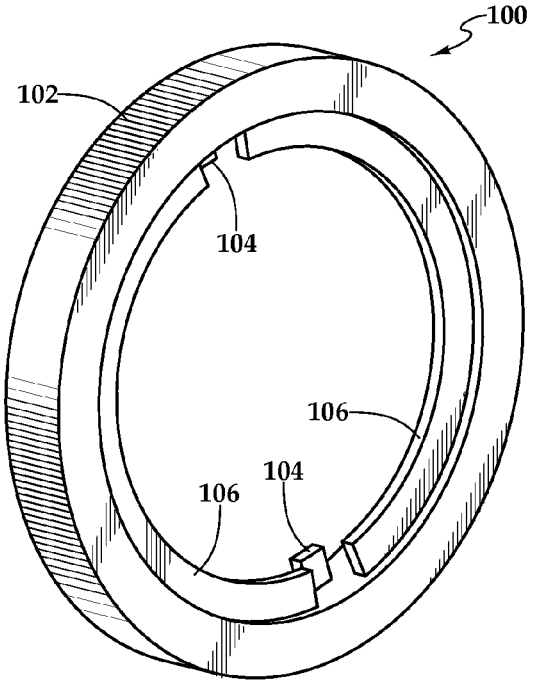

While various system, method and other embodiments are discussed in detail below, it should be appreciated that the present disclosure provides many applicable inventive concepts, which can be embodied in a wide variety of specific contexts. The specific embodiments discussed herein are merely illustrative, and do not delimit the scope of the present disclosure.

In a first aspect, the present disclosure is directed to a downhole depth, load and torque reference system. The system includes a first well feature disposed within a wellbore tubular having a first depth reference element, a first load reference element and a first torque reference element. A second well feature is disposed within the wellbore tubular having a second depth reference element, a second load reference element and a second torque reference element. A mating assembly is operable to be run downhole within the wellbore tubular on a conveyance. The mating assembly is operable to contact the first depth reference element to identify a first depth within the wellbore tubular, operable to engage the first torque reference element such that rotation of the conveyance at the surface transmits sufficient torque to break the first torque reference element and identify torque efficiency at the first depth, operable to engage the first load reference element such that applying weight at the surface to the conveyance transmits sufficient load to break the first load reference element and identify load efficiency at the first depth and operable to pass through the first well feature. In addition, the mating assembly is operable to contact the second depth reference element to identify a second depth within the wellbore tubular, operable to engage the second torque reference element such that rotation of the conveyance at the surface transmits sufficient torque to break the second torque reference element and identify torque efficiency at the second depth and operable to engage the second load reference element such that applying weight at the surface to the conveyance transmits sufficient load to break the second load reference element and identify load efficiency at the second depth.

In one embodiment, the first and second depth reference elements may each include at least one shearable element. In another embodiment, the first and second depth reference elements may each include a plurality of shearable elements. In some embodiments, the first and second torque reference elements may each include at least one torsionally shearable element having a known strength. In other embodiments, the first and second torque reference elements may each include a plurality of torsionally shearable elements having a known strength. In certain embodiments, the first and second load reference elements may each include at least one shearable element having a known strength. In other embodiments, the first and second load reference elements may each include a plurality of shearable elements having a known strength.

In a second aspect, the present disclosure is directed to a downhole depth, load and torque reference system. The system includes a well feature disposed within a wellbore tubular having a depth reference element, a load reference element and a torque reference element. A mating assembly is operable to be run downhole within the wellbore tubular on a conveyance. The mating assembly is operable to contact the depth reference element of the well feature to identify the depth of the well feature, operable to engage the torque reference element of the well feature such that rotation of the conveyance at the surface transmits sufficient torque to break the torque reference element to identify torque efficiency at the depth and operable to engage the load reference element of the well feature such that applying weight at the surface to the conveyance transmits sufficient load to break the load reference element to identify load efficiency at the depth.

In a third aspect, the present disclosure is directed to a downhole depth, load and torque reference method. The method includes disposing a well feature within a wellbore tubular, the well feature including a depth reference element, a load reference element and a torque reference element; running a mating assembly downhole within the wellbore tubular on a conveyance; contacting the depth reference element of the well feature with the mating assembly to identify a depth of the well feature; engaging the torque reference element of the well feature with the mating assembly; rotating the conveyance at the surface to transmit sufficient torque to break the torque reference element; identifying torque efficiency at the depth of the well feature; engaging the load reference element of the well feature with the mating assembly; applying weight at the surface to the conveyance to transmit sufficient load to break the load reference element; and identifying load efficiency at the depth of the well feature.

In the method, rotating the conveyance at the surface to transmit sufficient torque to break the torque reference element may occurs prior to or after applying weight at the surface to the conveyance to transmit sufficient load to break the load reference element. The method may also include breaking a plurality of torsionally shearable elements; breaking a plurality of shearable elements and/or passing the mating assembly through the well feature.

In a fourth aspect, the present disclosure is directed to a downhole depth and torque reference system. The system includes a well feature disposed within a wellbore tubular having a depth reference element and a torque reference element. A mating assembly is operable to be run downhole within the wellbore tubular on a conveyance. The mating assembly is operable to contact the depth reference element of the well feature to identify the depth of the well feature and operable to engage the torque reference element of the well feature such that rotation of the conveyance at the surface transmits sufficient torque to break the torque reference element to identify torque efficiency at the depth.

In a fifth aspect, the present disclosure is directed to a downhole depth and torque reference method. The method includes disposing a well feature within a wellbore tubular, the well feature including a depth reference element and a torque reference element; running a mating assembly downhole within the wellbore tubular on a conveyance; contacting the depth reference element of the well feature with the mating assembly to identify a depth of the well feature; engaging the torque reference element of the well feature with the mating assembly; rotating the conveyance at the surface to transmit sufficient torque to break the torque reference element; and identifying torque efficiency at the depth of the well feature.

In a sixth aspect, the present disclosure is directed to a downhole depth and load reference system. The system includes a well feature disposed within a wellbore tubular having a depth reference element and a load reference element. A mating assembly is operable to be run downhole within the wellbore tubular on a conveyance. The mating assembly is operable to contact the depth reference element of the well feature to identify the depth of the well feature and operable to engage the load reference element of the well feature such that applying weight at the surface to the conveyance transmits sufficient load to break the load reference element to identify load efficiency at the depth.

In a seventh aspect, the present disclosure is directed to a downhole depth and load reference method. The method includes disposing a well feature within a wellbore tubular, the well feature including a depth reference element and a load reference element; running a mating assembly downhole within the wellbore tubular on a conveyance; contacting the depth reference element of the well feature with the mating assembly to identify a depth of the well feature; engaging the load reference element of the well feature with the mating assembly; applying weight at the surface to the conveyance to transmit sufficient load to break the load reference element; and identifying load efficiency at the depth of the well feature.

Referring initially to FIG. 1, a system for depth, load and torque referencing in a wellbore is being operated from an offshore platform that is schematically illustrated and generally designated 10. A semi-submersible platform 12 is centered over submerged oil and gas formation 14 located below sea floor 16. A subsea conduit 18 extends from deck 20 of platform 12 to wellhead installation 22, including blowout preventers 24. Platform 12 has a hoisting apparatus 26, a derrick 28, a travel block 30, a hook 32 and a swivel 34 for raising, lowering, rotating and applying set down weight on pipe strings, such as a work string 36.

A main wellbore 38 has been drilled through the various earth strata including formation 14. The terms "parent" and "main" wellbore are used herein to designate a wellbore from which another wellbore is drilled. It is to be noted, however, that a parent or main wellbore does not necessarily extend directly to the earth's surface, but could instead be a branch of yet another wellbore. One or more surface and intermediate casing strings 40 have been installed in main wellbore 38 and have been secured therein by cement 42. The term "casing" is used herein to designate a tubular string used in a wellbore or to line a wellbore. The casing may be of the type known to those skilled in the art as a "liner" and may be made of any material, such as steel or a composite material and may be segmented or continuous, such as coiled tubing.

In a generally horizontal section of wellbore 38, casing string 40 includes a window joint 44 and a latch coupling 46. Window joint 44 may be of conventional design and may include or may not include a pre-milled window. Latch coupling 46 has a latch profile that is operably engagable with latch keys of a latch assembly such that the latch assembly may be axially anchored and rotationally oriented in latch coupling 46. In conventional practice, when the primary latch key of the latch assembly operably engages the primary latch profile of latch coupling 46, a deflection assembly such as a whipstock operably associated with the latch assembly is positioned in a desired circumferential orientation relative to window joint 44 such that a window can be milled in window joint 44 in the desired circumferential direction. Once the window is formed, a branch or lateral wellbore may be drilled from window joint 44 of main wellbore 38. The terms "branch" and "lateral" wellbore are used herein to designate a wellbore that is drilled outwardly from its intersection with another wellbore, such as a parent or main wellbore. A branch or lateral wellbore may have another branch or lateral wellbore drilled outwardly therefrom.

In the illustrated embodiment, casing string 40 has three well features 48, 50, 52 disposed therein. For example, well features 48, 50, 52 may be individual components positioned between and/or threadedly secured to adjacent tubular members of casing string 40 such as a pup joint. Alternatively, well features 48, 50, 52 may be positioned within and coupled to profiles or otherwise secured within casing string 40. As yet another alternative, certain portions of well features 48, 50, 52 may be integral with selected joints of casing string 40 such as by machining these portions of well features 48, 50, 52 into the selected joints of casing string 40. With the benefit of this disclosure, those skilled in the art will understand that well features 48, 50, 52 may be disposed within casing string 40 using a variety of installation, coupling and/or securing methods either prior to or after installation of casing string 40 in wellbore 38.

In the illustrated embodiment, a mating assembly 54 is positioned on the end of work string 36, which may be a joined tubing such as drill pipe, a coiled tubing, a composite coiled tubing or other suitable conveyance. As shown, mating assembly 54 has been run downhole within casing string 40 on conveyance 36 to a position proximate well feature 48. From this positioned, mating assembly 54 may be lowered into contact with a depth reference element of well feature 48 which enables the operator to identify the depth of well feature 48. Depending upon the desired sequence of testing, the configuration of mating assembly 54 and the orientation of well feature 48, mating assembly 54 may now be rotated to engage a torque reference element of well feature 48. In the engaged configuration, additional rotating of conveyance 36 at the surface transmits torque to the torque reference element of well feature 48. When sufficient torque is transferred, the torque reference element of well feature 48 will break. As the required torque to break the torque reference element of well feature 48 is known and the applied torque at the surface is known, the torque efficiency at the depth of well feature 48 can be determined. Either after or before testing for the torque efficiency, mating assembly 54 may engage a load reference element of well feature 48. In the engaged configuration, adding set down weight to conveyance 36 at the surface transmits an axial load to the load reference element of well feature 48. When sufficient load is transferred, the load reference element of well feature 48 will break. As the required load to break the load reference element of well feature 48 is known and the applied set down weight at the surface is known, the load efficiency at the depth of well feature 48 can be determined. After determining the depth of well feature 48, the load efficiency at the depth of well feature 48 and the torque efficiency at the depth of well feature 48, mating assembly 54 may pass through well feature 48 and be lowered deeper into wellbore 38.

As illustrated, wellbore 38 has a relatively tight radius between its substantially vertical section and its substantially horizontal section. This change in direction can create a region of high friction or high loss for the passage of subsequent tubular strings therethrough. To determine the amount of friction created therein, a well feature 50 has been positioned proximate to and downhole of the change in direction. Mating assembly 54 may be lowered into contact with a depth reference element of well feature 50, which enables the operator to identify the depth of well feature 50. Depending upon the desired sequence of testing, the configuration of mating assembly 54 and the orientation of well feature 50, mating assembly 54 may engage a load reference element of well feature 50. In the engaged configuration, adding set down weight to conveyance 36 at the surface transmits an axial load to the load reference element of well feature 50. When sufficient load is transferred, the load reference element of well feature 50 will break. As the required load to break the load reference element of well feature 50 is known and the applied set down weight at the surface is known, the load efficiency at the depth of well feature 50 can be determined. Either after or before testing for the load efficiency, mating assembly 54 may be rotated to engage a torque reference element of well feature 50. In the engaged configuration, additional rotating of conveyance 36 at the surface transmits torque to the torque reference element of well feature 50. When sufficient torque is transferred, the torque reference element of well feature 50 will break. As the required torque to break the torque reference element of well feature 50 is known and the applied torque at the surface is known, the torque efficiency at the depth of well feature 50 can be determined. After determining the depth of well feature 50, the load efficiency at the depth of well feature 50 and the torque efficiency at the depth of well feature 50, mating assembly 54 may pass through well feature 50 and be lowered deeper into wellbore 38. By comparing the load efficiency and/or the torque efficiency at the depth of well feature 48 and well feature 50, the operator is able to determine the losses associated with the change in direction of wellbore 38, if desired.

As illustrated, wellbore 38 has an extended reach substantially horizontal section that can create high resistance and/or high friction to axial as well as rotational movement of conveyance 36 within casing string 40. To determine the amount of friction created therein, a well feature 52 has been positioned proximate to window joint 44 and latch coupling 46. Mating assembly 54 may be lowered into contact with a depth reference element of well feature 52, which enables the operator to identify the depth of well feature 52. Depending upon the desired sequence of testing, the configuration of mating assembly 54 and the orientation of well feature 52, mating assembly 54 may engage a load reference element of well feature 52. In the engaged configuration, adding set down weight to conveyance 36 at the surface transmits an axial load to the load reference element of well feature 52. When sufficient load is transferred, the load reference element of well feature 52 will break. As the required load to break the load reference element of well feature 52 is known and the applied set down weight at the surface is known, the load efficiency at the depth of well feature 52 can be determined. Either after or before testing for the load efficiency, mating assembly 54 may be rotated to engage a torque reference element of well feature 52. In the engaged configuration, additional rotating of conveyance 36 at the surface transmits torque to the torque reference element of well feature 52. When sufficient torque is transferred, the torque reference element of well feature 52 will break. As the required torque to break the torque reference element of well feature 52 is known and the applied torque at the surface is known, the torque efficiency at the depth of well feature 52 can be determined. By comparing the load efficiency and/or the torque efficiency at the depth of well feature 50 and well feature 52, the operator is able to determine the losses associated with the extended reach substantially horizontal section of wellbore 38, if desired.

Even though FIG. 1 depicts a wellbore having a particular orientation, it should be understood by those skilled in the art that the present system is equally well suited for use in wellbores having other orientations including vertical wellbores, slanted wellbores, deviated wellbores or the like. Accordingly, it should be understood by those skilled in the art that the use of directional terms such as above, below, upper, lower, upward, downward, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well, the downhole direction being toward the toe of the well. Also, even though FIG. 1 depicts an offshore operation, it should be understood by those skilled in the art that the present system is equally well suited for use in onshore operations. In addition, even though FIG. 1 has been described as including three well features 48, 50, 52 at particular locations in the well, those skilled in the art will recognize that any number of well features may be disposed within the well at any desired location or depth therein. Further, the various well features may have load reference elements of the same or different strengths such that the same or a different amount of load is required to break the various load reference elements. Likewise, the various well features may have torque reference elements of the same or different strengths such that the same or a different amount of torque is required to break the various torque reference elements.

Referring next to FIGS. 2A-2D, therein are illustrated various views of a well feature for use in a system for depth, load and torque referencing in a wellbore according to an embodiment of the present disclosure that is generally designated 100. Well feature 100 includes an outer housing depicted as ring assembly 102, which may be formed from a metal or other suitable material. Ring assembly 102 may be operably positioned between adjacent tubular members of a tubular string, operably received within a profile of a tubular member, form a portion of a tubular member or the like. Extending generally radially inwardly from ring assembly 102 is a torque reference element depicted as a pair of oppositely positioned shear lugs 104. Shear lugs 104 are securably attached or coupled to ring assembly 102 by friction fit, adhesion, welding, threading or similar connection. Alternatively, shear lugs 104 could be integral with ring assembly 102 and formed by a machining process or other suitable process. Shear lugs 104 may be formed from a metal, a ceramic or other suitable material having a known shear value such that a predetermined shear force will cause shear lugs 104 to break and separate from ring assembly 102. Specifically, shear lugs 104 are selected to have a known shear value such that a torque efficiency at the depth of well feature 100 can be determined when a sufficient torsional force is applied to a conveyance at the surface that is coupled to a mating assembly engaged with shear lugs 104, wherein the torque efficiency is determined by a comparison of the applied torque at the surface and the known shear value of shear lugs 104.

Well feature 100 also has a load reference element depicted as a pair of oppositely positioned and generally radially inwardly extending arc shaped shear members 106. Shear members 106 are securably attached or coupled to ring assembly 102 by friction fit, adhesion, welding or similar connection. Alternatively, shear members 106 could be integral with ring assembly 102 and formed by a machining process or other suitable process. Shear members 106 may be formed from a metal, a ceramic or other suitable material having a known shear value such that a predetermined shear force will cause shear members 106 to break and separate from ring assembly 102. Specifically, shear members 106 are selected to have a known shear value such that a load efficiency at the depth of well feature 100 can be determined when a sufficient set down weight is applied to a conveyance at the surface that is coupled to a mating assembly engaged with shear members 106, wherein the load efficiency is determined by a comparison of the applied weight at the surface and the known shear value of shear members 106.

Figure 3A:
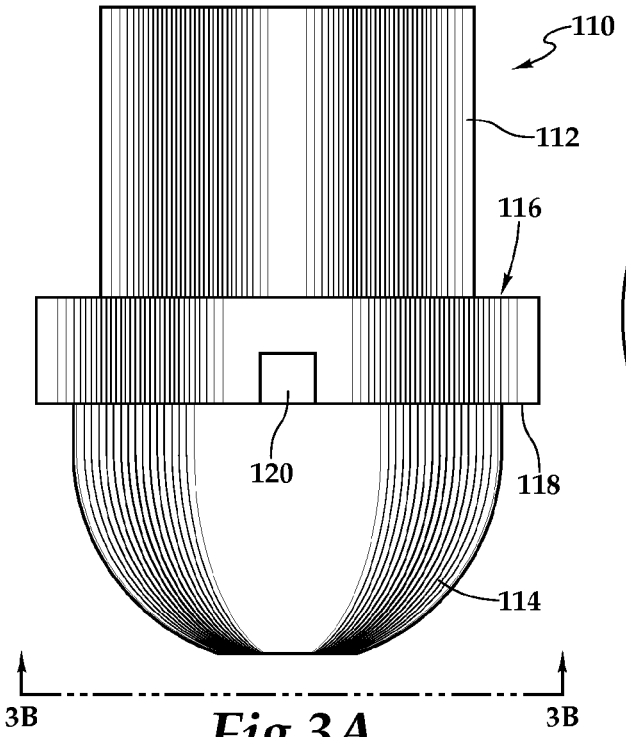
FIGS. 3A-3B are side and top views of a mating assembly for use in a system for depth, load and torque referencing in a wellbore according to an embodiment of the present disclosure.
Figure 3B:
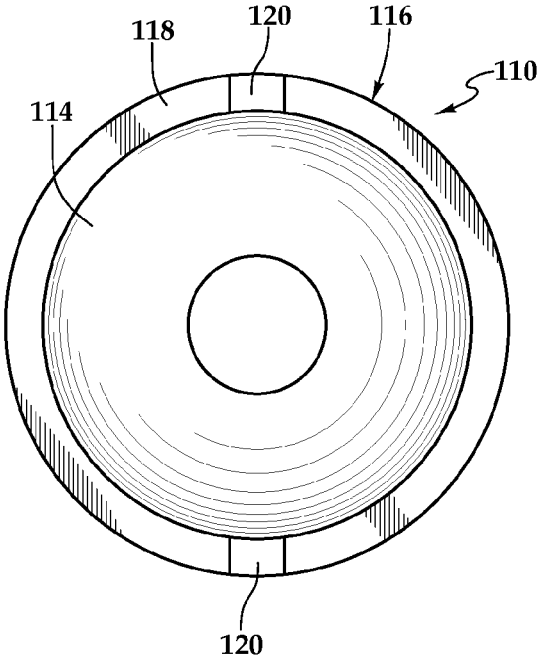

Referring next to FIGS. 3A-3B, therein are illustrated various views of a mating assembly for use in a system for depth, load and torque referencing in a wellbore according to an embodiment of the present disclosure that is generally designated 110. Mating assembly 110 includes an upper connector 112 that is operable to be coupled to the lower end of a conveyance such as work string 36. Mating assembly 110 has an alignment member 114 operable to centralize mating assembly 110 within a well feature such as well feature 100. Mating assembly 110 also includes a load and torque transfer member 116. Load and torque transfer member 116 has a load transfer shoulder 118 operable to engage shear members 106 of well feature 100. Load and torque transfer member 116 also has a pair of oppositely positioned torque transfer notches 120 operable to receive shear lugs 104 therein. As such, mating assembly 110 is designed to mate with well feature 100. With the benefit of this disclosure, those skilled in the art will recognize that well features having a different design than well feature 100 may require a mating assembly having a different design than mating assembly 110. For example, it may be desirable to have one or more alignment elements in a mating assembly to aid in the alignment of a load and torque transfer member with the elements of a particular well feature.

The operation of a system for depth, load and torque referencing in a wellbore according to an embodiment of the present disclosure will now be described with reference to FIGS. 2A-3B. Mating assembly 110 is preferably positioned on the end of a suitable conveyance such as work string 36 and lowered into the tubular string including well feature 100 until mating assembly 110 contacts well feature 100. Depending upon the exact configuration of mating assembly 110 as well as the orientation of well feature 100 and mating assembly 110, contact could be between load transfer shoulder 118 and either shear lugs 104 or shear members 106 or contact could be between torque transfer notches 120 and shear lugs 104. As such, either shear lugs 104, shear members 106 or both may serve as a depth reference element of well feature 100 as positive contact between mating assembly 110 and well feature 100 is used to determine the depth of well feature 100 in the well. Thereafter, depending upon the desired sequence of testing, the configuration of mating assembly 110 and the orientation of well feature 100 and mating assembly 110, either the torque efficiency or the load efficiency may be determined next.

In the case of determining the torque efficiency next, mating assembly 110 may be rotated to engage or assure previous engagement between torque transfer notches 120 and shear lugs 104. In the engaged configuration, additional rotating of conveyance 36 at the surface transmits torque to shear lugs 104 of well feature 100 via torque transfer notches 120 of mating assembly 110. When sufficient torque is transferred, shear lugs 104 of well feature 100 will break. As the required torque to break shear lugs 104 of well feature 100 is known and the applied torque at the surface is known, the torque efficiency at the depth of well feature 100 can be determined. Next, additional set down weight may be added to conveyance 36 at the surface to engage or assure previous engagement between load transfer shoulder 118 and shear members 106. In the engaged configuration, adding further set down weight to conveyance 36 at the surface transmits an axial load to shear members 106 of well feature 100 via load transfer shoulder 118 of mating assembly 110. When sufficient load is transferred, shear members 106 of well feature 100 will break. As the required load to break shear members 106 of well feature 100 is known and the applied set down weight at the surface is known, the load efficiency at the depth of well feature 100 can be determined. After determining the depth of well feature 100, the load efficiency at the depth of well feature 100 and the torque efficiency at the depth of well feature 100, mating assembly 110 may pass through well feature 100 and be lowered deeper into the well, if desired.

Figure 4A:
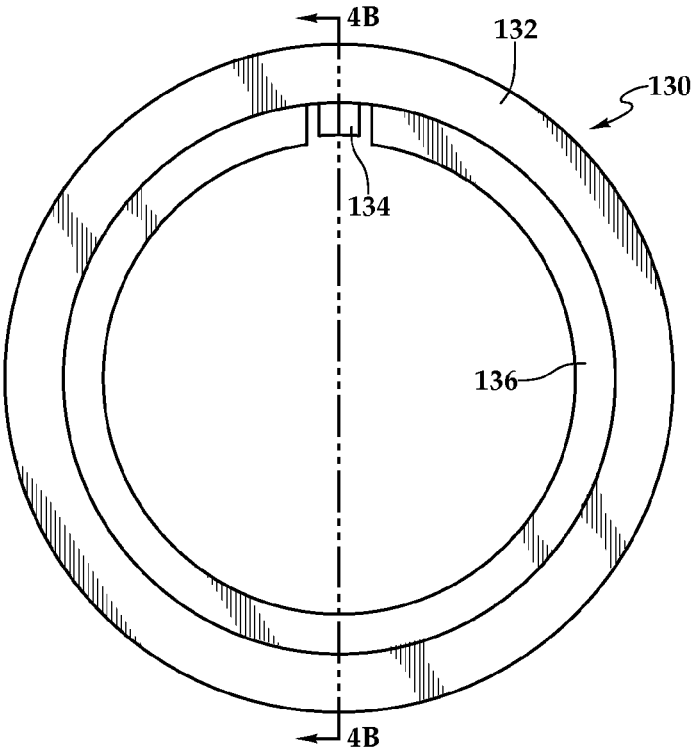
FIGS. 4A-4B are side and cross sectional views of a well feature for use in a system for depth, load and torque referencing in a wellbore according to an embodiment of the present disclosure.
Figure 4B:
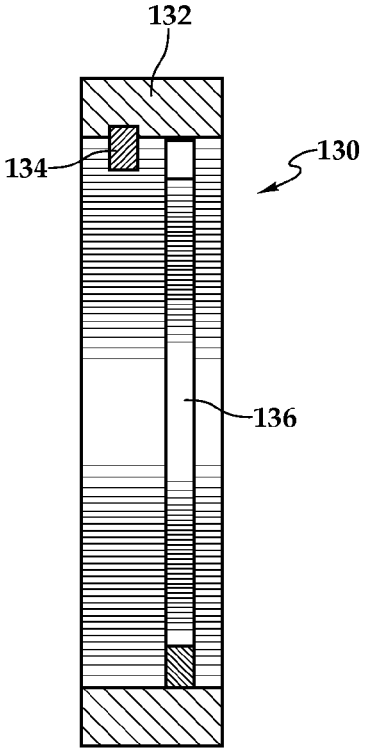

Even though a well feature having a particular number and orientation of load reference elements and torque reference elements has been described and depicted in FIGS. 2A-2D, it should be understood by those skilled in the art that well features having other numbers of load reference elements and torque reference elements in other orientations are possible and are contemplated by the present disclosure. For example, FIGS. 4A-4B illustrate various views of a well feature for use in a system for depth, load and torque referencing in a wellbore according to an embodiment of the present disclosure that is generally designated 130. Well feature 130 includes an outer housing depicted as ring assembly 132. Extending generally radially inwardly from ring assembly 132 is a torque reference element depicted as shear lug 134 having a known shear value such that a predetermined shear force will cause shear lug 134 to break. Specifically, shear lug 134 is selected to have a known shear value such that a torque efficiency at the depth of well feature 130 can be determined when a sufficient torsional force is applied to a conveyance at the surface that is coupled to a suitably designed mating assembly engaged with shear lug 134. Well feature 130 also includes a generally radially inwardly extending load reference element depicted as a substantially circular shaped shear member 136 having a known shear value such that a predetermined shear force will cause shear member 136 to break. Specifically, shear member 136 is selected to have a known shear value such that a load efficiency at the depth of well feature 130 can be determined when a sufficient set down weight is applied to a conveyance at the surface that is coupled to a suitably designed mating assembly engaged with shear member 136.

Figure 5A:
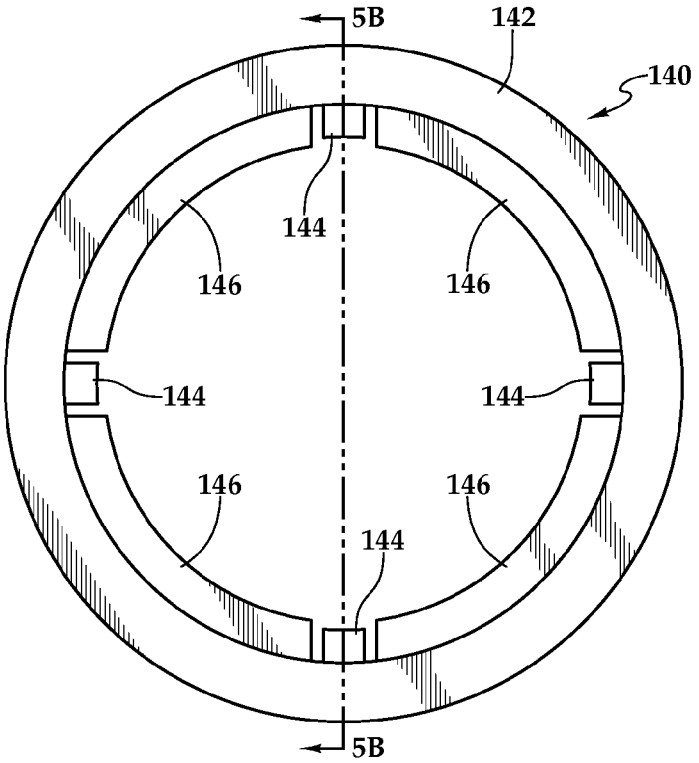
FIGS. 5A-5B are side and cross sectional views of a well feature for use in a system for depth, load and torque referencing in a wellbore according to an embodiment of the present disclosure.
Figure 5B:
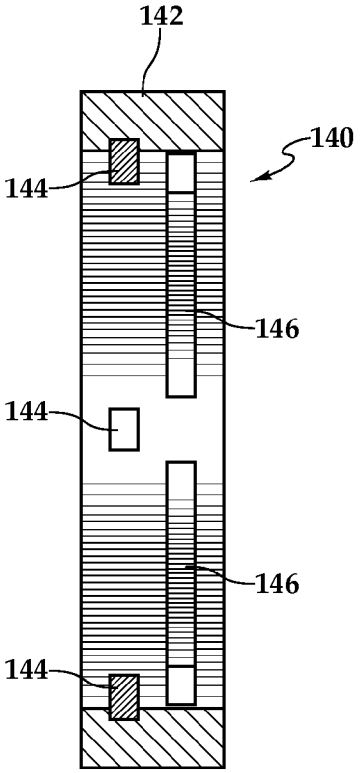

As another example, FIGS. 5A-5B illustrate various views of a well feature for use in a system for depth, load and torque referencing in a wellbore according to an embodiment of the present disclosure that is generally designated 140. Well feature 140 includes an outer housing depicted as ring assembly 142. Extending generally radially inwardly from ring assembly 142 is a torque reference element depicted as four shear lugs 144 having a known shear value such that a predetermined shear force will cause shear lugs 144 to break. Specifically, shear lugs 144 are selected to have a known shear value such that a torque efficiency at the depth of well feature 140 can be determined when a sufficient torsional force is applied to a conveyance at the surface that is coupled to a suitably designed mating assembly engaged with shear lugs 144. Well feature 140 also includes a generally radially inwardly extending load reference element depicted as four arc shaped shear members 146 having a known shear value such that a predetermined shear force will cause shear members 146 to break. Specifically, shear members 146 are selected to have a known shear value such that a load efficiency at the depth of well feature 140 can be determined when a sufficient set down weight is applied to a conveyance at the surface that is coupled to a suitably designed mating assembly engaged with shear members 146.

Figure 6A:
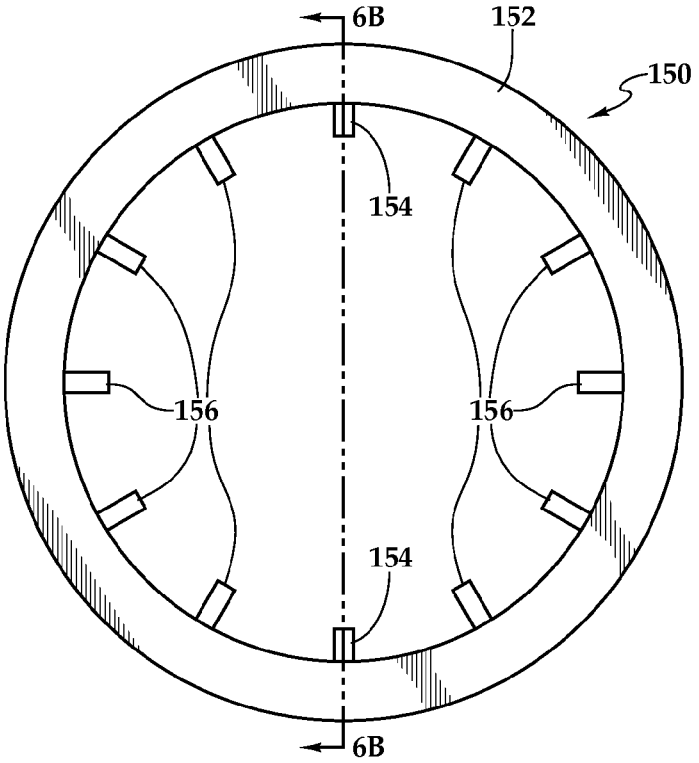
FIGS. 6A-6B are side and cross sectional views of a well feature for use in a system for depth, load and torque referencing in a wellbore according to an embodiment of the present disclosure.
Figure 6B:
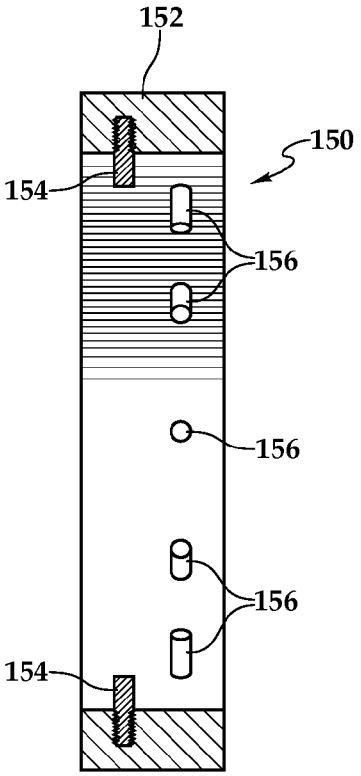

Referring next to FIGS. 6A-6B, therein are illustrated various views of a well feature for use in a system for depth, load and torque referencing in a wellbore according to an embodiment of the present disclosure that is generally designated 150. Well feature 150 includes an outer housing depicted as ring assembly 152. Extending generally radially inwardly from ring assembly 152 is a torque reference element depicted as are a pair of oppositely positioned shear pins 154 that are threadably coupled to ring assembly 152. Shear pins 154 have a known shear value such that a predetermined shear force will cause shear pins 154 to break. Specifically, shear pins 154 are selected to have a known shear value such that a torque efficiency at the depth of well feature 150 can be determined when a sufficient torsional force is applied to a conveyance at the surface that is coupled to a suitable designed mating assembly engaged with shear pins 154. Well feature 150 also includes a generally radially inwardly extending load reference element depicted as a plurality of shear pins 156 that are threadably coupled to ring assembly 152. Shear pins 156 have a known shear value such that a predetermined shear force will cause shear pins 156 to break. Specifically, shear pins 156 are selected to have a known shear value such that a load efficiency at the depth of well feature 150 can be determined when a sufficient set down weight is applied to a conveyance at the surface that is coupled to a mating assembly engaged with shear pins 156.

It should be understood by those skilled in the art that the illustrative embodiments described herein are not intended to be construed in a limiting sense. Various modifications and combinations of the illustrative embodiments as well as other embodiments will be apparent to persons skilled in the art upon reference to this disclosure. It is, therefore, intended that the appended claims encompass any such modifications or embodiments.

What is claimed is:

1. A downhole depth, load and torque reference system comprising:

a well feature disposed within a wellbore tubular, the well feature including a depth reference element, a load reference element and a torque reference element; and a mating assembly operable to be run downhole within the wellbore tubular on a conveyance;

wherein, the mating assembly is operable to contact the depth reference element of the well feature to identify a depth of the well feature, operable to engage the torque reference element of the well feature such that rotation of the conveyance at the surface transmits sufficient torque to break the torque reference element and identify torque efficiency at the depth of the well feature and operable to engage the load reference element of the well feature such that applying weight at the surface to the conveyance transmits sufficient load to break the load reference element and identify load efficiency at the depth of the well feature.

2. The system as recited in claim 1 wherein the depth reference element further comprises at least one shearable element.

3. The system as recited in claim 1 wherein the depth reference element further comprises a plurality of shearable elements.

4. The system as recited in claim 1 wherein the torque reference element further comprises at least one torsionally shearable element having a known strength.

5. The system as recited in claim 1 wherein the torque reference element further comprises a plurality of torsionally shearable elements having a known strength.

6. The system as recited in claim 1 wherein the load reference element further comprises at least one shearable element having a known strength.

7. The system as recited in claim 1 wherein the load reference element further comprises a plurality of shearable elements having a known strength.

8. A downhole depth, load and torque reference method comprising:

disposing a well feature within a wellbore tubular, the well feature including a depth reference element, a load reference element and a torque reference element;

running a mating assembly downhole within the wellbore tubular on a conveyance;

contacting the depth reference element of the well feature with the mating assembly to identify a depth of the well feature;

engaging the torque reference element of the well feature with the mating assembly;

rotating the conveyance at the surface to transmit sufficient torque to break the torque reference element;

identifying torque efficiency at the depth of the well feature;

engaging the load reference element of the well feature with the mating assembly;

applying weight at the surface to the conveyance to transmit sufficient load to break the load reference element; and identifying load efficiency at the depth of the well feature.

9. The method as recited in claim 8 wherein rotating the conveyance at the surface to transmit sufficient torque to break the torque reference element occurs prior to applying weight at the surface to the conveyance to transmit sufficient load to break the load reference element.

10. The method as recited in claim 8 wherein rotating the conveyance at the surface to transmit sufficient torque to break the torque reference element occurs after applying weight at the surface to the conveyance to transmit sufficient load to break the load reference element.

11. The method as recited in claim 8 wherein rotating the conveyance at the surface to transmit sufficient torque to break the torque reference element further comprises breaking a plurality of torsionally shearable elements.

12. The method as recited in claim 8 wherein applying weight at the surface to the conveyance to transmit sufficient load to break the load reference element further comprises breaking a plurality of shearable elements.

13. The method as recited in claim 8 further comprising passing the mating assembly through the well feature.

14. A downhole depth, load and torque reference system comprising:

a first well feature disposed within a wellbore tubular, the first well feature including a first depth reference element, a first load reference element and a first torque reference element;

a second well feature disposed within the wellbore tubular, the second well feature including a second depth reference element, a second load reference element and a second torque reference element; and a mating assembly operable to be run downhole within the wellbore tubular on a conveyance;

wherein, the mating assembly is operable to contact the first depth reference element to identify a first depth within the wellbore tubular, operable to engage the first torque reference element such that rotation of the conveyance at the surface transmits sufficient torque to break the first torque reference element and identify torque efficiency at the first depth, operable to engage the first load reference element such that applying weight at the surface to the conveyance transmits sufficient load to break the first load reference element and identify load efficiency at the first depth and operable to pass through the first well feature; and wherein, the mating assembly is operable to contact the second depth reference element to identify a second depth within the wellbore tubular, operable to engage the second torque reference element such that rotation of the conveyance at the surface transmits sufficient torque to break the second torque reference element and identify torque efficiency at the second depth and operable to engage the second load reference element such that applying weight at the surface to the conveyance transmits sufficient load to break the second load reference element and identify load efficiency at the second depth.

15. The system as recited in claim 14 wherein the first and second depth reference elements each further comprises at least one shearable element.

16. The system as recited in claim 14 wherein the first and second depth reference elements each further comprises a plurality of shearable elements.

17. The system as recited in claim 14 wherein the first and second torque reference elements each further comprises at least one torsionally shearable element having a known strength.

18. The system as recited in claim 14 wherein the first and second torque reference elements each further comprises a plurality of torsionally shearable elements having a known strength.

19. The system as recited in claim 14 wherein the first and second load reference elements each further comprises at least one shearable element having a known strength.

20. The system as recited in claim 14 wherein the first and second load reference elements each further comprises a plurality of shearable elements having a known strength.

* * * * *